US006508886B1

(12) United States Patent
Ciaralli et al.

(10) Patent No.: US 6,508,886 B1
(45) Date of Patent: Jan. 21, 2003

(54) METHOD FOR PREPARING A PURIFIED SUGARY JUICE FROM RAW JUICES OBTAINED FROM SACCHARIFEROUS MATERIAL OF VEGETABLE ORIGIN

(75) Inventors: Fabrizio Ciaralli, Rome (IT); Ernesto Carosini, Genoa (IT); Anja de Reus-Jorna, Leiden (NL); Franco Maniscalco, Bologna (IT)

(73) Assignee: Ondeo Nalco Company, Naperville, IL (US)

( * ) Notice: Subject to any disclaimer, the term of this patent is extended or adjusted under 35 U.S.C. 154(b) by 211 days.

(21) Appl. No.: 09/723,086

(22) Filed: Nov. 27, 2000

(30) Foreign Application Priority Data

Feb. 4, 2000 (IT) ..... GE2000 A 14

(51) Int. Cl.[7] ..... C13D 3/16
(52) U.S. Cl. ..... 127/55
(58) Field of Search ..... 127/55

(56) References Cited

U.S. PATENT DOCUMENTS 6,238,486 B1 * 5/2001 Dunham et al. ..... 127/53

6,387,186 B1 * 5/2002 Reisig et al. ..... 127/54

* cited by examiner

*Primary Examiner*—David Brunsman
(74) *Attorney, Agent, or Firm*—Michael B. Martin; Thomas M. Breininger

(57) ABSTRACT

An embodiment of the present invention described and shown in the specification is a method for the preparation of a purified sugary juice from raw juices obtained from sacchariferous material of vegetable origin. The embodiment of the method that is disclosed includes the steps of coarse-filtering the raw juices, adding a suitable processing adjuvant to the juice, separating the juice from suspended phases and membrane-filtering the juice thus obtained. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims. 37 CFR 1.72(b).

13 Claims, 1 Drawing Sheet

METHOD FOR PREPARING A PURIFIED SUGARY JUICE FROM RAW JUICES OBTAINED FROM SACCHARIFEROUS MATERIAL OF VEGETABLE ORIGIN

CROSS REFERENCE TO RELATED APPLICATION

This application claims the priority of Italian patent application Serial No. GE2000 A 14 filed on Feb. 4, 2000.

The present invention relates to a method for the production of a purified sacchariferous juice from raw juices obtained from sacchariferous material of vegetable origin, and in particular from sacchariferous plants such as sugar beet or sugar cane.

Typically, in the purification, on an industrial scale, of raw sugar-beet juices, huge quantities of lime are used and therefore in these production plants furnaces for producing the lime from limestone are required. The clear juices obtained following this treatment, which is generally performed twice during the course of the same purification process, are then concentrated and crystallised in order to produce the sugar.

This type of technology, which has been used for a very long time in the sector, has high costs from an energy point of view, in addition to a considerable environmental impact due essentially to the clarification sludges of the juices, which may constitute as much as 8–10% of the beet treated. Moreover, it must also be stated that this method requires the use of a considerable quantity of quarry lime, in the region of 5% and more, relative to the weight of the beet.

Methods for purification of the raw juices which do not involve the use of lime treatment are known; in particular, these methods make use of filtration onto suitable membranes. These systems, however, have encountered objective difficulties with regard to their industrial application, since the suspended substances present in the raw juices cause blockage of the membranes and the stagnation thereof forms areas which are the source of infection.

The object of the present invention is therefore to provide a method for the preparation of a purified sugary juice which, not involving purification operations which use lime treatment, may be both readily and effectively applied on an industrial level.

The present invention therefore relates to a method for the preparation of a purified sugary juice from raw juices obtained from sacchariferous material of vegetable origin, comprising the steps of:

- coarse filtration of the extracted juice by means of diffusion and/or pressing of the vegetable mass;
- correction, if necessary, of the pH and subsequent heating of the previously filtered juice;
- addition of a suitable processing adjuvant, for example a; coagulating agent, to the juice, preferably with stirring;
- separation of the juice from the suspended phases; and
- membrane-filtration of the juice thus obtained.

In a mode of implementation of the method according to the present invention, coarse filtration is performed by means of a steel-mesh filter with openings in the range of 200–1000 $\mu$m, preferably in the region of 500 $\mu$m.

Heating, where necessary, is performed to a temperature generally of between 75 and 95° C., and preferably 80 and 85° C.

The processing adjuvant which is introduced into the raw juice is preferably a polycationic polymer coagulating agent, such as in particular poly-diallyl-dimethylammonium chloride.

Further advantages and characteristic features will emerge from the following description of a mode of implementation of the method according to the present invention, provided, by way of a non-limiting example, with reference to the sole accompanying plate of drawings, in which:

BRIEF DESCRIPTION OF THE DRAWING

FIG. 1 shows the diagram of a plant conceived in accordance with the method of the present invention. 1 denotes the diffuser into which the sacchariferous material of vegetable origin, in this case suitably cut sugar beet, is introduced and from which a raw juice is extracted. This raw juice, which contains impurities in suspended form, is initially screened by means of the steel-mesh filter 2 with openings in the region of 500 $\mu$m. With this type of filtration, it is possible to eliminate, right from the start of the process, the large fragments of beet which are suspended in the juice.

Figure 1:
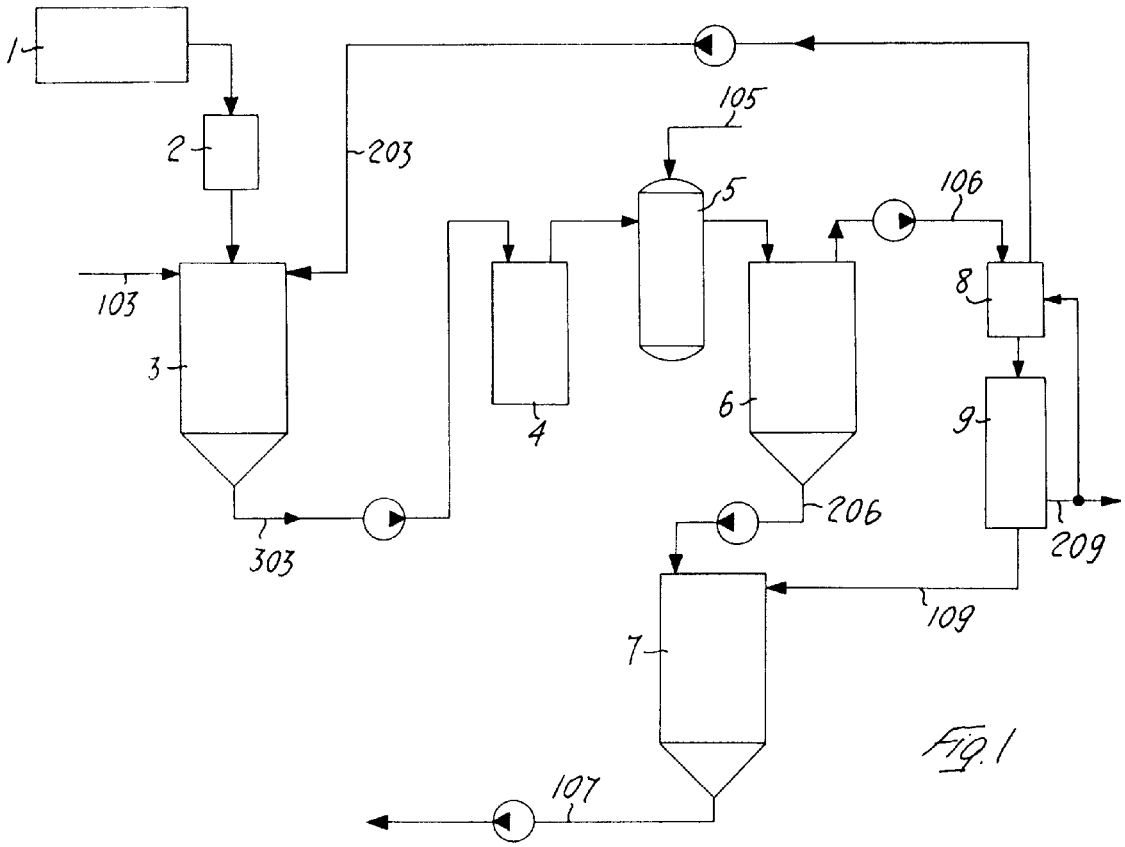
FIG. 1 is a schematic diagram showing a plant for implementing the method according to the present invention.

After this first filtration, the juice is conveyed into the tank 3 where correction of the pH, indicated by the arrow 103, is performed. The juice is then directed, via the line 303, to the heater 4 where it is heated to a temperature of 80–85° C. This increase in the temperature has the aim of favouring the coagulation of certain substances present in the juice in colloidal form, such as proteins, amino acids and pectins.

The juice is transferred from the heater 4 to the reactor 5 where the processing adjuvant, i.e. poly-diallyl-dimethylammonium chloride (poly-DADMAC), obtained by means of radical polymerisation of diallyl dimethylammonium, is added with stirring. This product, which is known in the treatment of drinking water, favours the destabilization of the colloids by means of the formation of micelles in the gel state. These micelles not only incorporate the vegetable and mineral particles, but also have an intense and surprising absorbing action with regard to numerous colouring substances present in the juice. It has been possible to note in the juice, following this treatment, a reduction in the colour from 8000–10,000 ICUMSA units to 2500–3000 units. Moreover, the product does not cause soiling of the membranes used for filtration of the juices. It is preferable that the reactor 5 should be of the dynamic type, namely that it is provided with stirring means able to provide the appropriate mechanical energy which, together with the processing adjuvant, allows separation of the material present in suspended form.

The next stage in the process involves the separation of the suspended phases from the juice. Said juice is then introduced into the decanter 6; the clear overlying liquid is conveyed by means of the line 106 to the set of membranes 9, after further safety filtering through the filter 8, with openings in the range of 1 to 50 $\mu$m, and preferably 3 $\mu$m.

The decanter 6 may be an insulated and/or heated decanter provided with a system for partial recirculation of the sludges; the decanter has, arranged inside it (not shown in the figures), scraper blades and foaming blades. It must be stated that the said function of the decanter 6 may also be effectively performed by a clarifier/flocculator, preferably of the fluid-bed type, or a continuous or discontinuous centrifugal separator.

The residual portion of the juice left inside the decanter 6 is conveyed, by means of the line 206, to the tank 7 where it is combined with the material 109 retained by the set of membranes 9. These fractions are conveyed along the line 107 for further treatment, if necessary by means of dialysis filtration, for recovery of sugar. The permeated liquid emerging from the line 209 of the set of membranes 9 is used partly for washing the filter 8, and the residue deposited on said filter is conveyed away to the tank 3 by means of the line 203.

This permeated liquid is an optimum sterile juice suitable for the production of a syrup with a high sugar concentration which may be stored as such or immediately conveyed away for the crystallisation and refining processes.

As a result of the method according to the present invention it is therefore possible to obtain, with a reduced environmental impact and with an energy requirement which is very much smaller than that of the systems currently used in the industry, a high-purity product which above all is significantly colour-free.

In particular, owing to the use of a coagulating agent such as a processing adjuvant and preferably the use of poly-DADMAC, large-scale production cycles are able to employ membrane filtration which hitherto had been used to a very small extent because of the difficulties resulting from the possible blockage of the said membranes.

What is claimed is:

1. A Method for the preparation of a purified sugary juice from raw juices obtained from sacchariferous material of vegetable origin, comprising the steps of:

coarse-filtering the raw juices by means of diffusion and/or pressing from the vegetable mass;

adding a suitable processing adjuvant to the juice, preferably with stirring;

separating the juice from suspended phases; and membrane-filtering the juice thus obtained.

2. A Method according to claim 1 further comprising, between the step of filtering and the step of adding, correcting the pH of the raw juice to a value between 6.5 and 8.

3. A Method according to claim 2 further comprising, after the step of correcting, the step of heating the raw juice.

4. A Method according to claim 3 wherein the step of heating is performed to a temperature of between 75° and 95° C.

5. A method according to claim 4 wherein the step of heating is performed to a temperature of between 80° C. and 85° C.

6. A Method according to claim 1 wherein the step of coarse-filtering is performed by means of a filter with steel meshes having openings in the range of 200 to 1000 $\mu$m.

7. A Method according to claim 6 wherein the openings of said steel meshes are in the region of 500 $\mu$m.

8. A Method according to claim 1 wherein the processing adjuvant which is introduced into the raw juice is a coagulating agent.

9. A Method according to claim 8 wherein the processing adjuvant is a polycationic polymeric coagulating agent.

10. A Method according to claim 9 wherein the processing adjuvant is poly-diallyl-dimethylammonium chloride.

11. A Method according to claim 1 wherein the step of separating the juice from the suspended phases is performed in a heated and/or insulated decanter provided with scraper blades and foaming blades.

12. A Method according to claim 1 wherein the step of separating the juice from the suspended phases is performed in a fluid-bed clarifies/flocculator.

13. A Method according to claim 1 wherein the step of separating the juice from the suspended phases is performed in a continuous or discontinuous centrifugal separator.

* * * * *